US005522498A

United States Patent [19]

Chang

[11] Patent Number: 5,522,498

[45] Date of Patent: Jun. 4, 1996

[54] STATIONERY ORGANIZER

[76] Inventor: Feng-Hsing Chang, P.O. Box 82-144, Taipei, Taiwan

[21] Appl. No.: 437,659

[22] Filed: May 9, 1995

[51] Int. Cl.[6] ..... A47F 7/00; B43M 17/00

[52] U.S. Cl. ..... 206/214; 206/216; 206/371

[58] Field of Search ..... 206/214, 216, 206/224, 576, 242, 371, 305, 320

[56] References Cited

U.S. PATENT DOCUMENTS 4,289,249 9/1981 Cripe ..... 206/371 X 4,972,947 11/1990 McCarthy ..... 206/214

*Primary Examiner*—Jacob K. Ackun

*Attorney, Agent, or Firm*—Alfred Lei

[57] ABSTRACT

A stationery organizer including a base, a plurality of seat plates, a plurality of first bolts, a plurality of second bolts, a plurality of third bolts, a plurality of nuts, characterized in that the base is generally triangular in shape and provided with a threaded hole at its center and three holes 11 each at one of its angular portion, the seat plate has the same shape and size as the base and is provided with three holes each at one of its triangular portion and provided at the central portion with an opening, the first bolt is formed with a threaded hole at its lower end and a threaded portion at its upper end, the second bolt is shorter than the first bolt and formed with a threaded portion at both ends which is adapted to engage with the threaded hole of the first bolt, the third bolt is shorter than the second bolt and formed with a threaded hole at its lower end and a threaded portion at the upper end, whereby the stationery organizer can be easily changed in shape as desired.

10 Claims, 6 Drawing Sheets

STATIONERY ORGANIZER

BACKGROUND OF THE INVENTION

1. Field of the Invention

This invention relates to an improved stationery organizer.

2. Description of the Prior Art

It has been found that the conventional stationery holder is simply a cylindrical member for receiving pencils, erasers, paper clips, or the like. However, such a stationery holder has no other functions than receiving stationery thereby limiting its use.

Therefore, it is an object of the present invention to provide a stationery holder which can obviate and mitigate the above-mentioned drawbacks.

SUMMARY OF THE INVENTION

This invention relates to a stationery organizer.

It is the primary object of the present invention to provide a stationery organizer which is easy to assemble.

It is another object of the present invention to provide a stationery organizer which is multi-functional in use.

It is still another object of the present invention to provide a stationery organizer which is facile to stow.

It is still another object of the present invention to provide a stationery organizer which is convenient for transportation.

It is a further object of the present invention to provide a stationery organizer which is low in cost.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
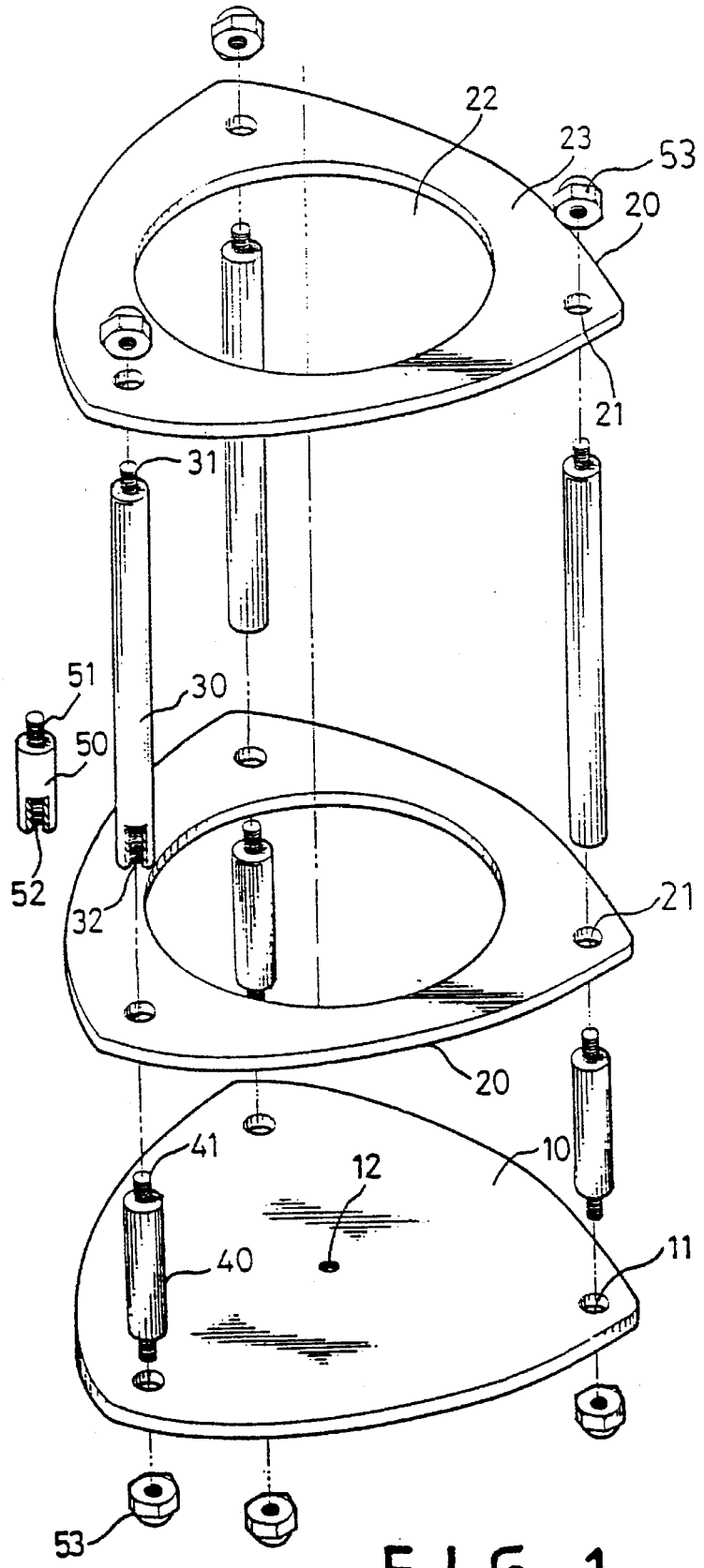
FIG. 1 is a exploded view of the invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
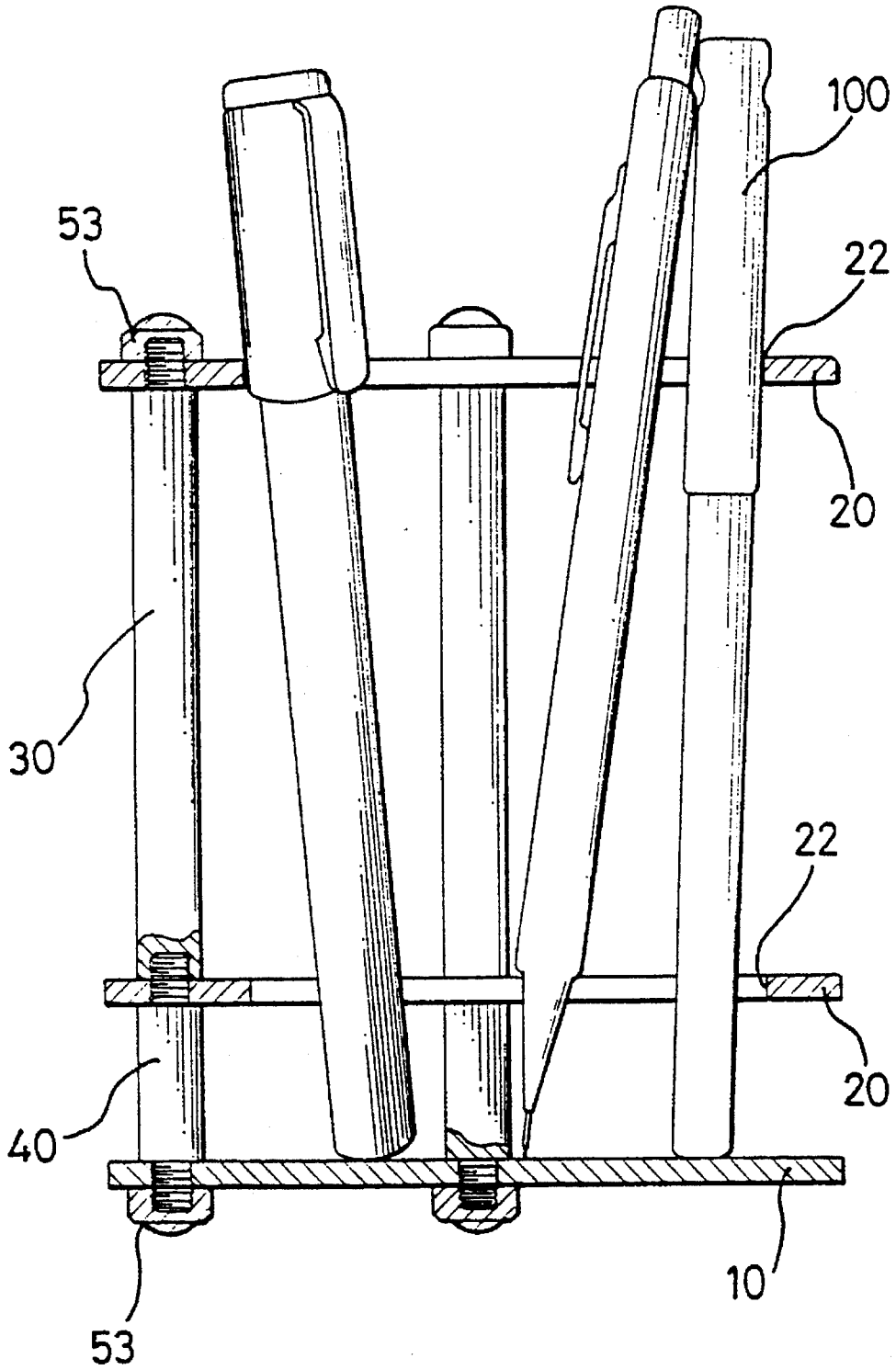
FIG. 2 shows a first preferred embodiment of the invention.

With reference to the drawings and in particular to FIGS. 1 and 2 thereof, the stationery organizer according to the present invention mainly comprises a base 10, a plurality of seat plates 20, a plurality of first bolts 30, a plurality of second bolts 40, a plurality of locking nuts 53, and a plurality of third bolts 50.

The base 10 is generally triangular in shape and may be in the shape of a polygon, circle, or the like). The base 10 is provided with a threaded hole 12 at its center and three holes 11 each at one of its angular portion. The seat plate 20 has the same shape and size as the base 10 and is provided with three holes 21 each at one of its triangular portion. Further, the seat plate 20 is provided at the central portion with an opening 22 thereby forming an edge 23 between the opening 22 and the threaded holes 21. The first bolt 30 is formed with a threaded hole 32 at its lower end and a threaded portion 31 at its upper end. The second bolt 40 is shorter than the first bolt 30 and formed with a threaded portion 41 at both ends which is adapted to engage with the threaded hole 32 of the first bolt 30. The third bolt 50 is shorter than the second bolt 40 and formed with a threaded hole 52 at its lower end and a threaded portion 51 at the upper end.

FIG. 2 illustrates a first preferred embodiment of the present invention. As shown, the lower ends 41 of the three second bolts 40 extend downwardly through the holes 11 of the base 10 to engage with nuts 53. A first seat plate 20 is supported by the three second bolts 40, with its holes 21 receiving the threaded portions 41 of the second bolts 40. The threaded holes 32 of the first bolts. 30 are engaged with the upper end 41 of the second bolts 40. A second seat plate 21 is supported by the three first bolts 30, with its holes 21 receiving the upper ends 31 of the first bolts 30. Three bolts 53 are engaged with the upper ends 31 of the first bolts 30 thereby forming a stationery holder for receiving pens 100 or the like.

Figure 3:
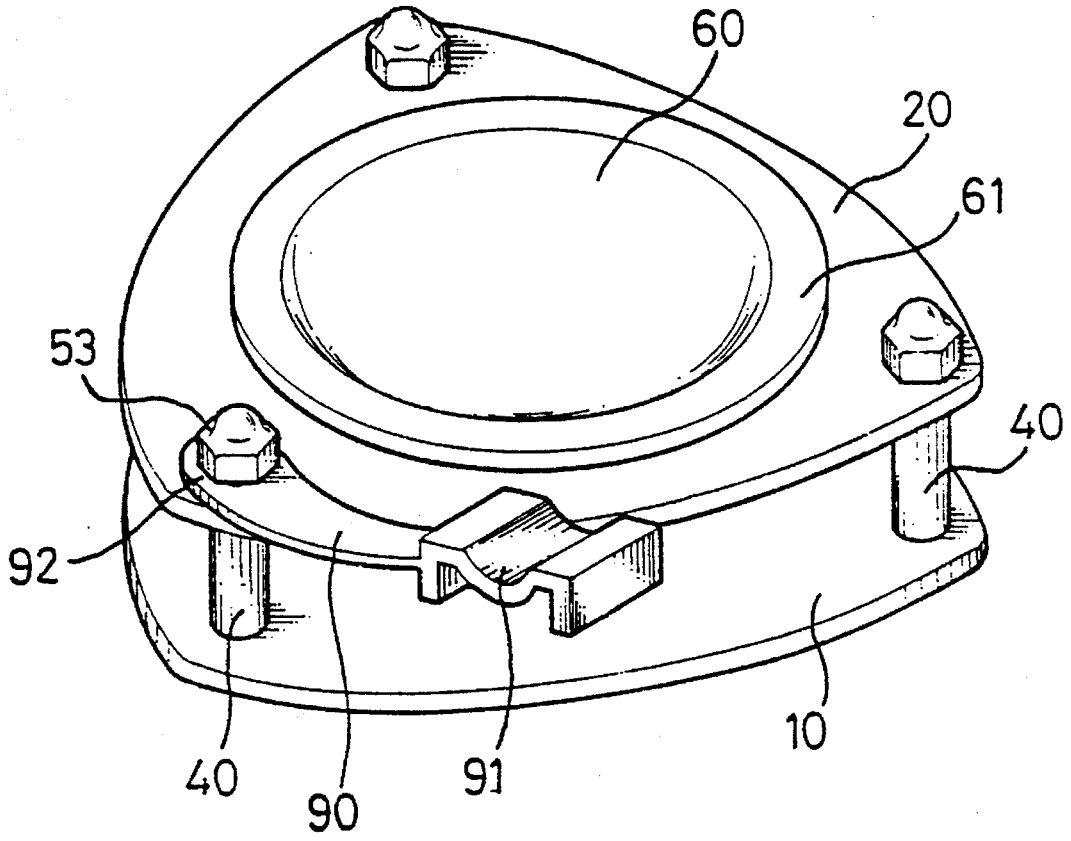
FIG. 3 is a prespective view of a second preferred emodiment of the invention.

FIG. 3 is a perspective view of a second preferred embodiment of the present invention. As illustrated, the lower ends of the three second bolts 40 extend downwardly through the holes 11 of the base 10 to engage with the nuts 53. A first seat plate 20 is supported by the three second bolts 40, with its holes receiving the threaded portions 41 of the second bolts 40. Three bolts 53 are engaged with the upper ends 41 of the second bolts 40. A disk 60 with a flange 61 larger than the opening 22 of the first seat plate 20 is arranged on the opening 22 of the first seat plate 20. An arm 90, which is formed with a hole at an end 92 and a cigarette support 91 at the other, is pivotally connected with the upper end 41 of the second bolt 40.

Figure 4:
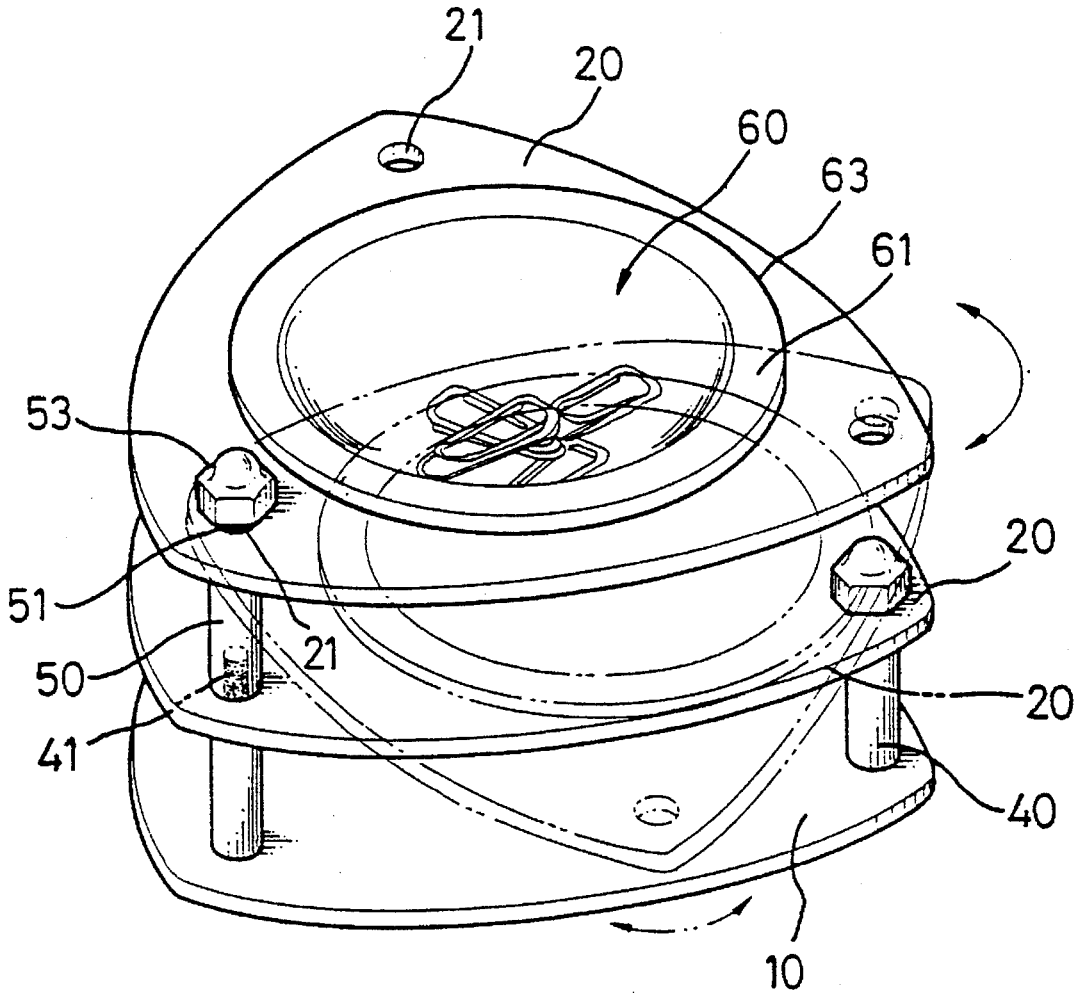
FIG. 4 shows a third preferred embodiment of the invention.

FIG. 4 shows a third preferred embodiment of the present invention. As may be seen, the lower ends of the three second bolts 40 extend downwardly through the holes 11 of the base 10 to engage with the nuts 53. A first seat plate 20 is supported by the three second bolts 40, with its holes receiving the threaded portions 41 of the second bolts 40. The lower end of the third bolt 50 is threadedly engaged with the upper end of one of the second bolts 40. The upper ends of the other two of the second bolts 40 are each engaged with a nut 53. A second seat plate 20 is supported by the third bolt 50. The upper end of the third bolt 50 extend upwardly through the hole 21 of the second seat plate 20 to engage with a nut 53. The nut 53 is loosely connected with the upper end of third bolt 50 so that the second seat plate 20 can be rotated. A disk 60 with a flange 61 larger than the opening 22 of the second seat plate 20 is arranged on the opening 22 of the second seat plate 20 so that the disk 60 can be conveniently used for receiving paper clips or the like.

Figure 5:
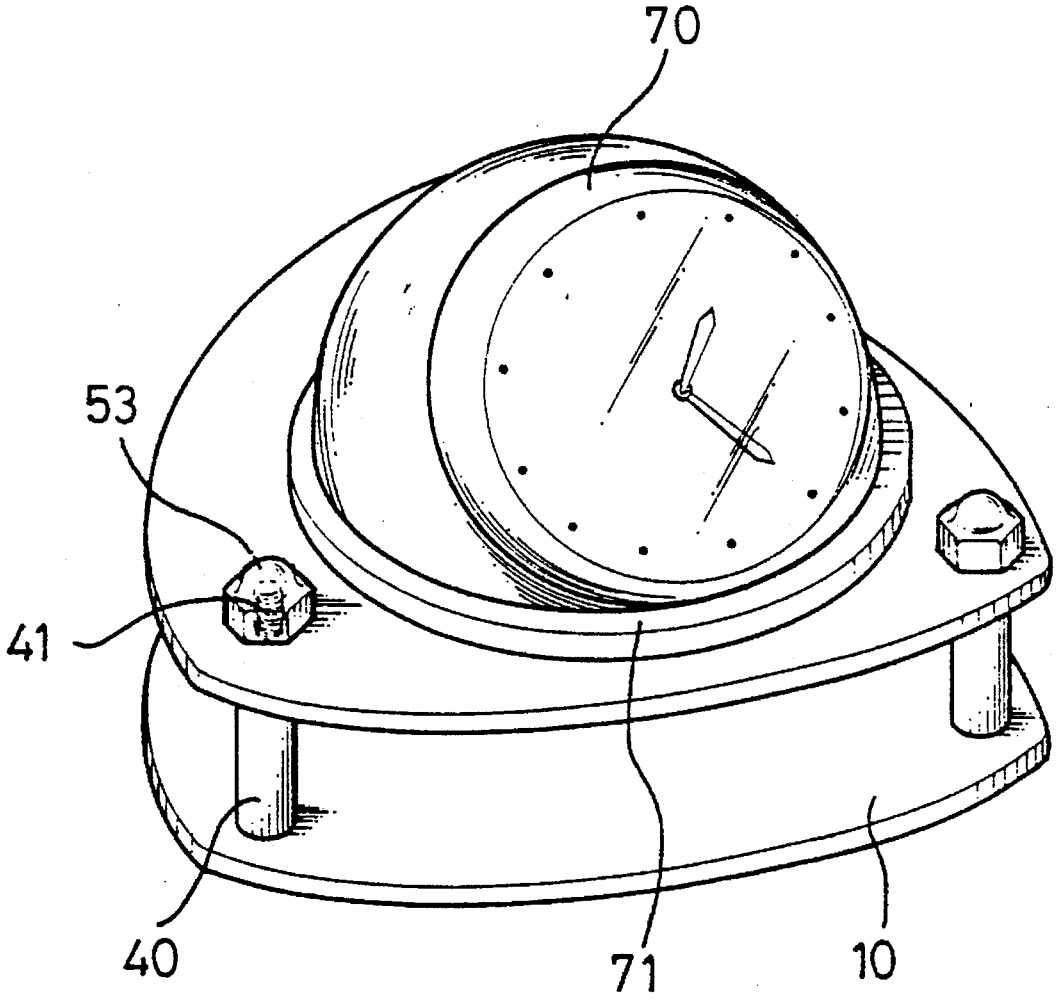
FIG. 5 shows a fourth preferred embodiment of the invention.

FIG. 5 shows a fourth preferred embodiment of the present invention. As illustrated, the lower ends of the three second bolts 40 extend downwardly through the holes 11 of the base 10 to engage with the nuts 53. A first seat plate 20 is supported by the three second bolts 40, with its holes receiving the threaded portions 41 of the second bolts 40. Three bolts 53 are engaged with the upper ends 41 of the second bolts 40. A clock 70 with a flange 71 larger than the opening 22 of the first seat plate 20 is arranged on the opening 22 of the first seat plate 20.

Figure 6:
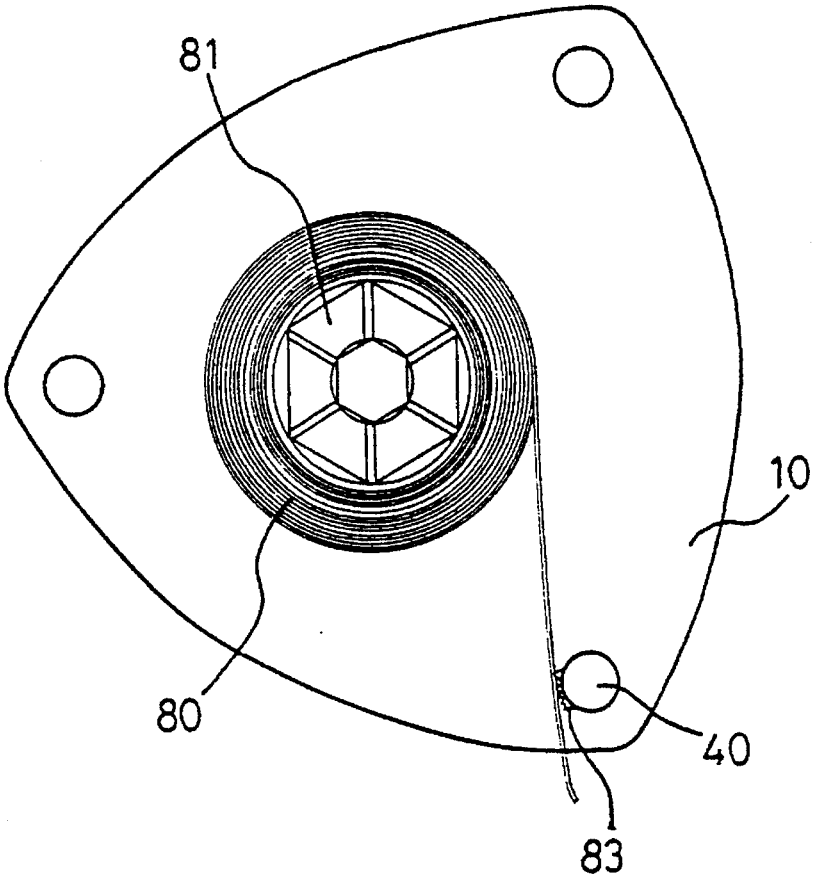
FIG. 6 and 7 show a fifth preferred embodiment of the invention.
Figure 7:
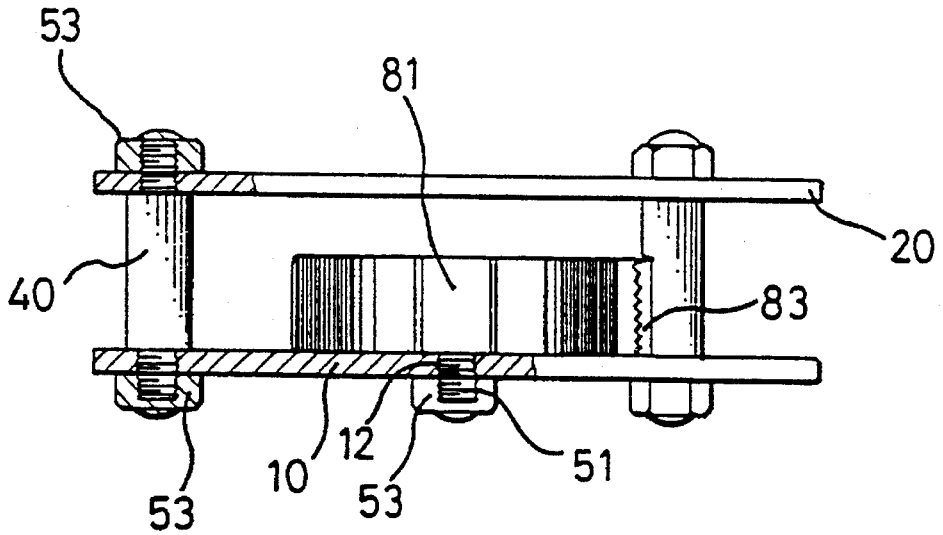

FIGS. 6 and 7 show a fifth preferred embodiment of the present invention. As shown, a third bolt 50 is engaged with the threaded hole 12 of the base 10 at the lower end and with a nut 53 at the upper end. A tape 80 with a reel 81 is rotatably mounted on the third bolt 50. A cutter 83 is fitted on one of the second bolts 40 for severing the tape 80.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A stationery organizer comprising:

a base provided with a threaded hole at a center thereof and a plurality of first holes at a circumferential portion thereof;

a plurality of seat plates each having a center opening and a plurality of second holes aligned with the first holes of said base;

a plurality of first bolts each having an externally threaded portion at an upper end and an internally threaded portion at a lower end and disposed between every two of said seat plates;

a plurality of second bolts each having a threaded portion at both ends and mounted between said base and a lowermost one of said seat plates;

a plurality of nuts engaged with lower ends of said second bolts and upper ends of uppermost ones of said first bolts.

2. The stationery organizer as claimed in claim 1, further comprising a disk arranged on a center opening of an uppermost one of said seat plates.

3. The stationery organizer as claimed in claim 1, further comprising an arm having an end pivotally connected with one of said first bolts and having another end formed with a cigarette support.

4. The stationery organizer as claimed in claim 1, further comprising a cutter fitted on one of said second bolts.

5. The stationery organizer as claimed in claim 1, wherein said base and seat plate have same shape and size.

6. The stationery organizer as claimed in claim 1, wherein said base and seat plate are generally triangular in shape.

7. The stationery organizer as claimed in claim 1, wherein said base and seat plate are generally circular in shape.

8. The stationery organizer as claimed in claim 1, wherein said base and seat plate are generally polygonal in shape.

9. The stationery organizer as claimed in claim 1, further comprising a clock installed on a center opening of an uppermost one of said seat plates.

10. The stationery organizer as claimed in claim 1, further comprising a reel rotatably mounted on a third bolt engaged with the threaded hole of said base.

* * * * *